US008545251B2

(12) United States Patent
Gordon et al.

(10) Patent No.: US 8,545,251 B2
(45) Date of Patent: Oct. 1, 2013

(54) LOCKING ELECTRICAL SOCKET

(76) Inventors: Peter J. Gordon, Salt Lake City, UT (US); Matthew Masner, Kaysville, UT (US); Therin Garrett, Mapleton, UT (US)

( * ) Notice: Subject to any disclaimer, the term of this patent is extended or adjusted under 35 U.S.C. 154(b) by 34 days.

(21) Appl. No.: 13/405,294

(22) Filed: Feb. 25, 2012

(65) Prior Publication Data

US 2013/0224984 A1 Aug. 29, 2013

(51) Int. Cl.
*H01R 13/625* (2006.01)

(52) U.S. Cl.
USPC ..... 439/346

(58) Field of Classification Search
USPC ..... 439/346, 102
See application file for complete search history.

(56) References Cited

U.S. PATENT DOCUMENTS 1,694,056 A * 12/1928 Calkins ..... 439/346
2,704,831 A * 3/1955 Smith ..... 439/346
2,801,394 A * 7/1957 Derner et al. ..... 439/346
3,891,289 A * 6/1975 Hanke ..... 439/106
4,060,297 A * 11/1977 Marshall et al. ..... 439/149
4,136,919 A * 1/1979 Howard et al. ..... 439/346
4,167,658 A * 9/1979 Sherman ..... 200/43.02
4,909,749 A * 3/1990 Long ..... 439/263
5,286,213 A * 2/1994 Altergott et al. ..... 439/139
5,336,103 A * 8/1994 Herboldsheimer ..... 439/346
5,352,132 A * 10/1994 O'Keefe et al. ..... 439/346
5,393,239 A * 2/1995 Ursich ..... 439/180
5,791,931 A * 8/1998 Burkhart, Sr. ..... 439/346
6,428,339 B1 * 8/2002 Davidson et al. ..... 439/346
6,619,975 B2 * 9/2003 Bentley et al. ..... 439/346
7,175,463 B2 * 2/2007 Burton ..... 439/346
7,452,230 B1 * 11/2008 Miller et al. ..... 439/346
8,152,554 B2 * 4/2012 Chapel et al. ..... 439/346

* cited by examiner

*Primary Examiner* — Neil Abrams
(74) *Attorney, Agent, or Firm* — Steven Rinehart

(57) ABSTRACT

A locking electrical plug is disclosed having a rigid tubular housing which rotates axially around a partially enclosed cylindrical socket face. As the tubular housing rotates, internally projecting cam engages clevis pins on the socket face, which pins lock through apertures of male electrical prongs detachably inserted into jacks on the socket face. The clevis pins are disengaged from the electrical prongs as the tubular body is rotated backward, the clevis pins biased back into an open position by resilient springs. Certain embodiments of the present invention recite electrical outlet embodiments comprising a plurality of socket faces. The locking electrical socket securely retains the male end of a US 120 volt electrical plug, but may be embodied to retain the male end of a US 220 volt electrical plug or electrical plugs of various international standards.

6 Claims, 10 Drawing Sheets

LOCKING ELECTRICAL SOCKET

BACKGROUND OF THE INVENTION

1. Field of the Invention

This invention relates to electrical plugs, and more particularly relates to electrical sockets with locking mechanisms for detachably securing male electrical plugs.

2. Description of the Related Art

Electrical sockets power appliances and tools in every home and business in the United States. Countless electronic devices, from televisions, to refrigerators, to air conditioners, are plugged into electrical sockets for indefinite periods of time by hundreds by millions of people. With periodic movement of these devices, and pressure on the male pins insertably connected to the electrical sockets, many plugs come free unexpectedly. In some instances, extension cords are pulled free by users attempting to extend their length, inadvertently disengaging the extension cords from the electrical sockets. In other cases, lights, garage door openers, and extension cords plugged into the ceiling of garages can come lose and be difficult to reconnect.

Electrical plugs are secured to sockets only by the mild compressive force of conductivity pieces with the jacks which become fatigued over time. There exists a need in the art for a simple locking electrical socket for securing electrical plugs in place which is reliable for indefinite periods of time.

SUMMARY OF THE INVENTION

From the foregoing discussion, it should be apparent that a need exists for a locking electrical socket. Beneficially, such a saw would overcome many of the difficulties with prior art by providing a more functional apparatus to consumers and professionals with a more effective locking mechanism.

The present invention has been developed in response to the present state of the art, and in particular, in response to the problems and needs in the art that have not yet been fully solved by currently available apparatii and methods. Accordingly, the present invention has been developed to provide a locking electrical socket comprising: a hollow cylindrical body defining an internal recess, the cylindrical body having two open ends for housing a cylindrical socket face and partially housing a t-member, the cylindrical body comprising an internal cam for engaging one more clevis pins, the cam partially circumscribing the inner surface of the cylindrical body; wherein the internal recess defined by the cylindrical body is of non-uniform diameter, such that the diameter of the recess across a lateral axis is smaller than the diameter of the internal recess across a longitudinal axis.

The locking electrical socket further comprises a cylindrical socket face having two or more jacks for receiving the male pins of an electrical plug, the jacks comprising one or more conductivity pieces for engaging with electrical contact the male pins, the socket face defining one or more recesses for receiving one or more clevis pins for closing and engaging apertures on the male pins; wherein the clevis pins are biased in an open position by one or more resilient springs, wherein the clevis pins are closed to engage the male pins by the cam rotating across the clevis pins when the cylindrical body is twisted axially around the socket face; and a rigid member mounted inside the cylindrical body to one of the cylindrical socket face and a component affixed to cylindrical socket face, the rigid member traversing the longitudinal axis of the inner recess, the rigid member of a length longer the diameter of inner recess across its lateral axis, the rigid member of a length less than the diameter of the inner recess across its longitudinal axis, such that cylindrical body can only rotated axially around the rigid member until a diameter of the inner recess as measured across the rigid member is reduced to the length of the rigid member.

In some embodiments, an outer surface of the cylindrical body may comprise one or more planar facets. The cylindrical socket face may further comprise a substantially planar outer face comprising a centrally located bore hole for receiving a screw, the screw affixing the cylindrical socket face to an abutting member partially enveloped by the cylindrical body. The clevis pins may further comprise convex heads, the convex heads engaged by the cam.

In some embodiments, the cylindrical body further comprises a crescent recess interiorly traversing the length of the cylindrical body, the crescent recess expanding the length of the diameter of the inner recess.

A locking electrical outlet having a plurality of electrical sockets is also recited, the electrical outlet comprising: a hollow housing defining a plurality of internal recesses, a face of the housing defining a plurality the cylindrical openings, each opening for housing a cylindrical socket face, the housing comprising internal cam for engaging one more clevis pins on the cylindrical socket faces; and a plurality of cylindrical socket faces having two or more jacks for receiving the male pins of an electrical plug, the jacks comprising one or more conductivity pieces for engaging with electrical contact the male pins, the socket face defining one or more recesses for receiving one or more clevis pins for closing and engaging apertures on the male pins when the male pins are insertably and detachably connected to an electrical socket; wherein the clevis pins are biased in an open position by one or more resilient springs affixed to a socket face, wherein the clevis pins are closed to engage the male pins by the cam rotating across the clevis pins when the socket face is twisted axially within the housing.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
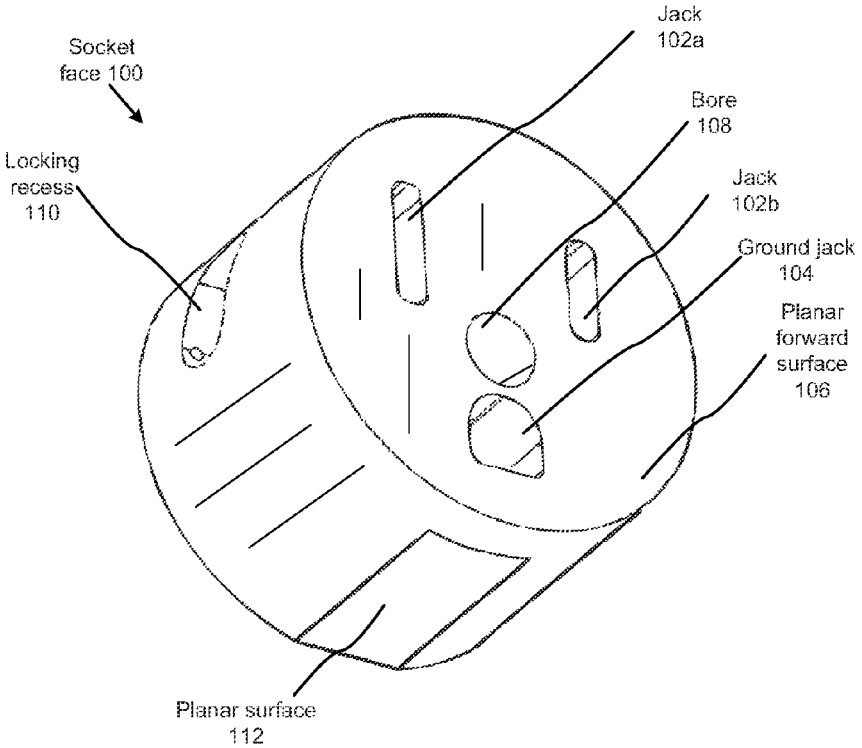
FIG. 1 is a lower elevational perspective view of a socket face in accordance with the present invention.

FIG. 1 is a lower elevational perspective view of a socket face 100 in accordance with the present invention. The socket face 100 comprises a cylindrical component having a jack 102*a*, a jack 102*b*, a ground jack 104, a planar forward surface 106, a bore hole 108, a locking recess 110, and a planar lower surface.

The socket face 100 comprises a cylindrical member with a forward planar surface 106 with a centrally located bore hole 108 for receiving a screw, the screw used to affix the socket face 100 to an abutting member on the rearward face of the socket face 100.

The jacks 102*a-b* comprise prong receiving bore openings for receiving the male prongs of standardized US 120 volt electrical plugs. In other embodiments, the jacks 102*a-b* are shaped so as to receive male electrical prongs of other standardized sizes commonly used in countries and regions across the globe, including 220 volt plugs.

The jacks 102*a-b* comprise contact terminals for electrically engaging male prongs inserted into the jacks 102*a-b*.

The socket face 100 comprises two locking recesses 110 for receiving clevis pins, which clevis pins are forced inward through apertures in male prongs to lock the male prongs in place.

The socket face 100 may be formed from any non-conductive polymeric material.

Figure 2:
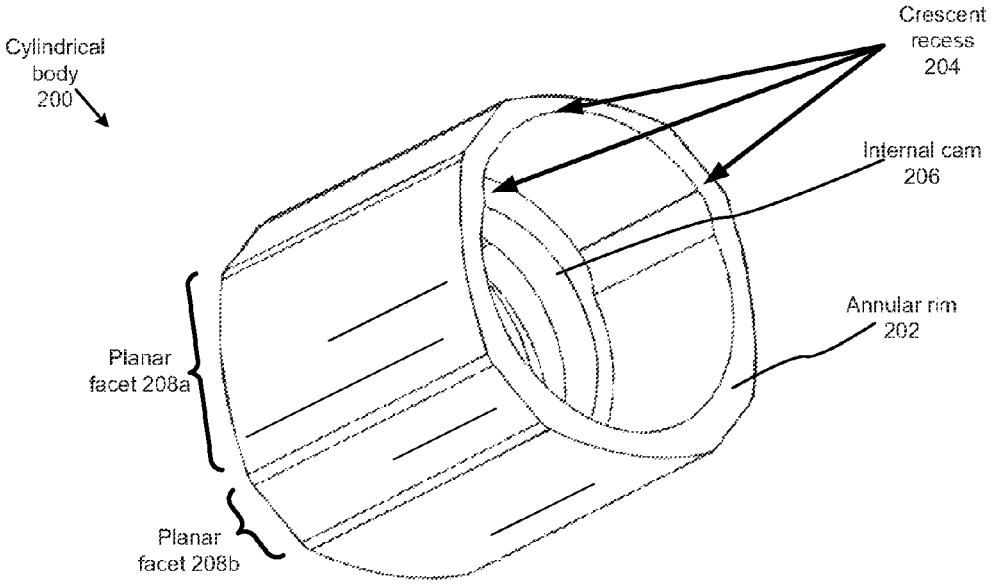
FIG. 2 is a lower elevational perspective view of a cylindrical body in accordance with the present invention.

FIG. 2 is a lower elevational perspective view of a hollow cylindrical body 200 in accordance with the present invention. The hollow cylindrical body 200 comprises an annular rim 202, a crescent recess 204, an internal cam 206, a planar facet 208*a*, and a planar facet 208*b*.

The cylindrical body 200 comprises a non-conductive elongated hollow cylindrical casing, body, or housing with an open forward end for receiving the socket face 100 and a t-member described below affixed to the socket face 100. The cylindrical body 200 may be insulated.

The cylindrical body 200 comprises inwardly projecting helical ridging forming an internal cam 206 which engages convex heads on clevis pins as the cylindrical body 200 is rotated around the socket face 100.

The internal cam 206 may be manufactured through means known to those of skill in the art, including additive, subtractive, taps and dies, single point threading, thrilling, grinding, molding, lapping, rolling and the like.

The cylindrical body 200 may comprise a plurality of planar facets 208 on its outer face for showing the rotational position of the cylindrical body 200 relative to the socket face 100 and other components of the locking electrical socket.

The cylindrical body 200 defines a hollow inner recess. In some embodiments, the inner recess is of non-uniform diameter across different axes of the cylindrical body 200 such that an elongated, rigid component traversing the longest diameter direction prevents axial rotation of the cylindrical body 200 as the diameter narrows during rotation of the cylindrical body 200 around the rigid component.

The cylindrical body 200 comprises two annular rims 202 with planar outward faces, a forward rim and rearward rim.

Figure 3:
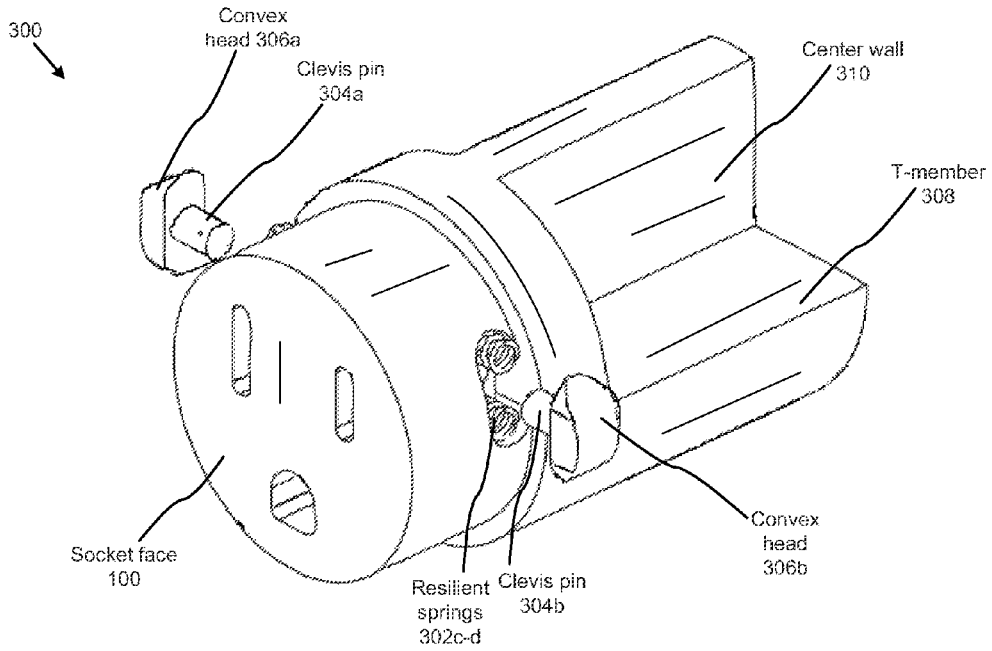
FIG. 3 is a side elevational perspective view of a socket face and T-member assembly in accordance with the present invention.

FIG. 3 is a side elevational perspective view of a socket face and T-member assembly 300 in accordance with the present invention. The assembly 300 comprises a socket face 100, resilient springs 302*c-d*, a clevis pin 304*a*, a clevis pin 304*b*, a convex head 306*a*, a convex head 306*b*, a t-member 308, and a center wall 310.

The socket face 100 is affixed to a plurality of resilient springs 302, which bias open clevis pins 304 affixed to the resilient springs 302.

The clevis pins 304*a-d* comprises depressible shanks, clevis pins, shafts, bolts, or gyves for engaging the apertures on standardized US 120 volt male electrical prongs inserted into the socket face 100.

The clevis pins 304*a-b* are biased by the resilient springs 302*a-d* into their open position. When the cylindrical body 200 is rotated around the socket face 100, the cam 206 engages the convex heads 306*a-b* and presses them inward, forcing the clevis pins 304*a-b* through apertures on the male electrical plugs inserted into the jacks 102*a-b*. When the cylindrical body 200 is rotated back to its original position, the cam 206 disengages from the convex heads 306*a-b* which heads 306*a-b* are disengaged from the male electrical inserts by the resilient springs 302*a-d*.

The convex heads 306 may comprise flattened heads or tabs curving outward in convex form along their outer face.

The t-member 308 comprises a polymeric, non-conducting member affixed to the rearward face of the socket face 100. In the shown embodiment, the t-member 308 comprises a central wall 310 extending upwardly. In the shown embodiment, the central wall 310, measure from the bottom of the t-member 308 to the top of the central wall 310 excess the horizontal (i.e. lateral axis) diameter of the inner recess of cylindrical body 200, but does not exceed the longitudinal axis diameter of the inner recess as measured across the inner recess and the crescent recess, such that the cylindrical body 200 cannot rotate fully around the central wall 310.

Figure 4:
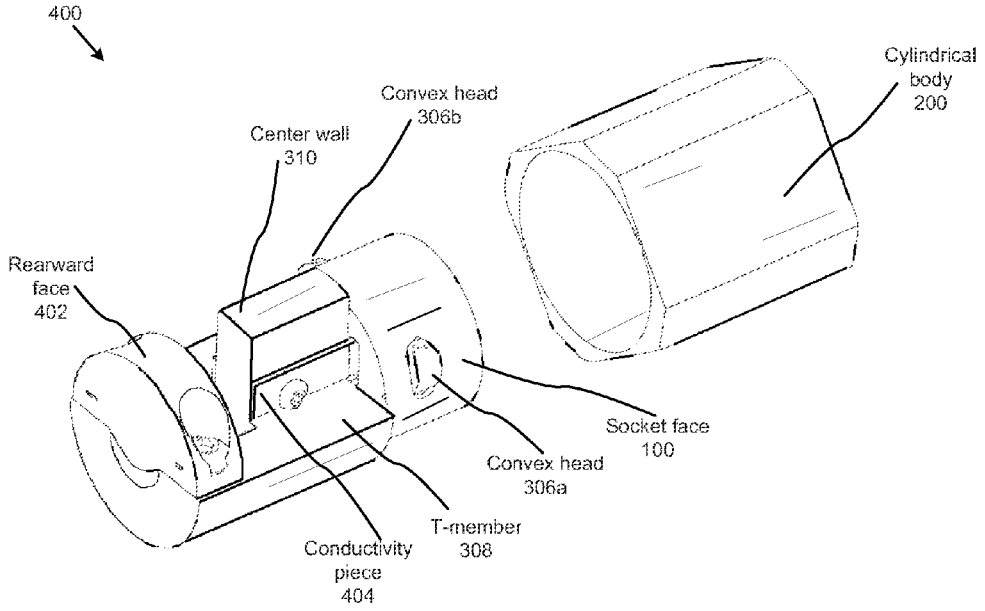
FIG. 4 is a side elevational perspective view of a partially disassembled locking electrical socket in accordance with the present invention.

FIG. 4 is a side elevational perspective view of a partially disassembled locking electrical socket 400 in accordance with the present invention. The electrical socket 400 comprises a socket face 100, a cylindrical body 200, a t-member 308, a convex head 306*a*, a convex head 306*b*, a center wall 310, a rearward face 402, and a conductivity piece 404.

A semi-cylindrical component, the rearward face 402, may be affixed to the upper portion of the t-member 308. The rearward face 402 may formed with coupling means for coupling the locking electrical socket to wire of varying gauges.

Conductivity pieces 404 are affixed to the lateral flanges of the central wall 310. The conductivity pieces 404 are engaged in electrical contact by the male prongs of an electrical plug.

Figure 5:
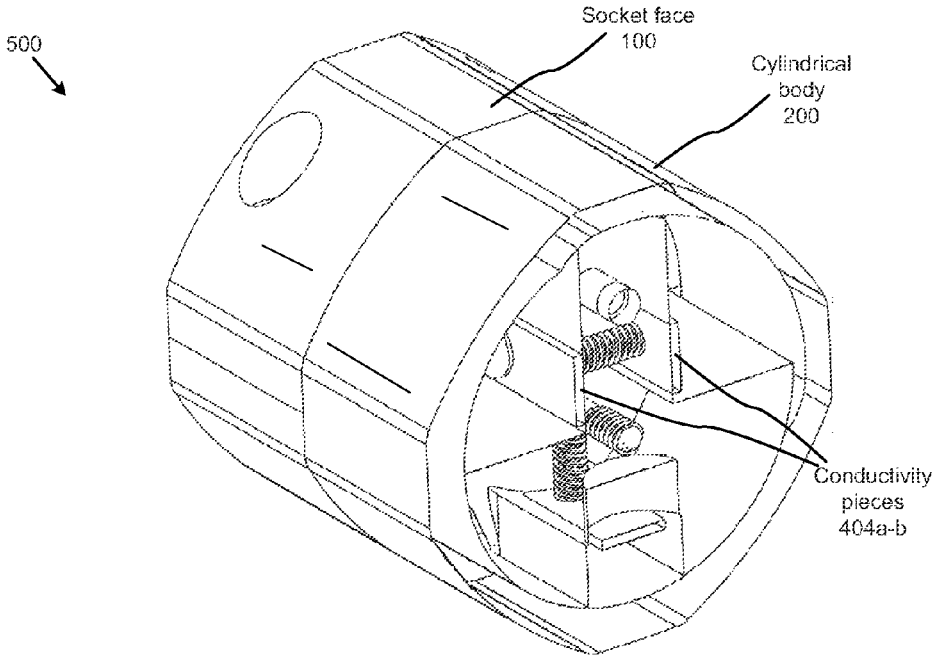
FIG. 5 is a forward side elevational sectioned perspective view of a partially disassembled locking electrical socket in accordance with the present invention.

FIG. 5 is a forward side elevational sectioned perspective view of a partially disassembled locking electrical socket 500 in accordance with the present invention. The electrical socket 500 comprises a socket face 100, a cylindrical body 200, and conductivity pieces 404*a-b*.

As shown, the conductivity pieces 404*a-b* are affixed interiorially to the cylindrical socket face 100 using screw/bolt mechanisms, or via other means known to those of skill in the art.

Figure 6:
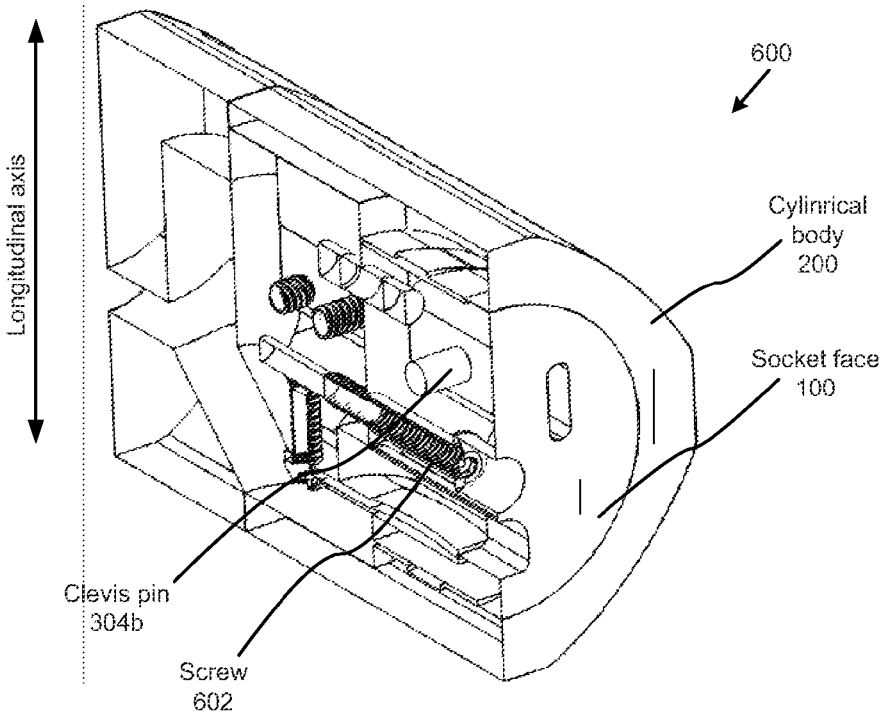
FIG. 6 is a forward side elevational cross-sectioned perspective view of a partially disassembled locking electrical socket in accordance with the present invention.

FIG. 6 is a forward side elevational cross-sectioned perspective view of a partially disassembled locking electrical socket 600 in accordance with the present invention. The electrical socket 600 comprises a socket face 100, a cylindrical body 200, a clevis pin 304*b*, and a screw 602.

As shown, the clevis pin 304*b* slides laterally along the lateral axis in and out of an aperture defined by a male prong inserted into a jack 102.

Figure 7:
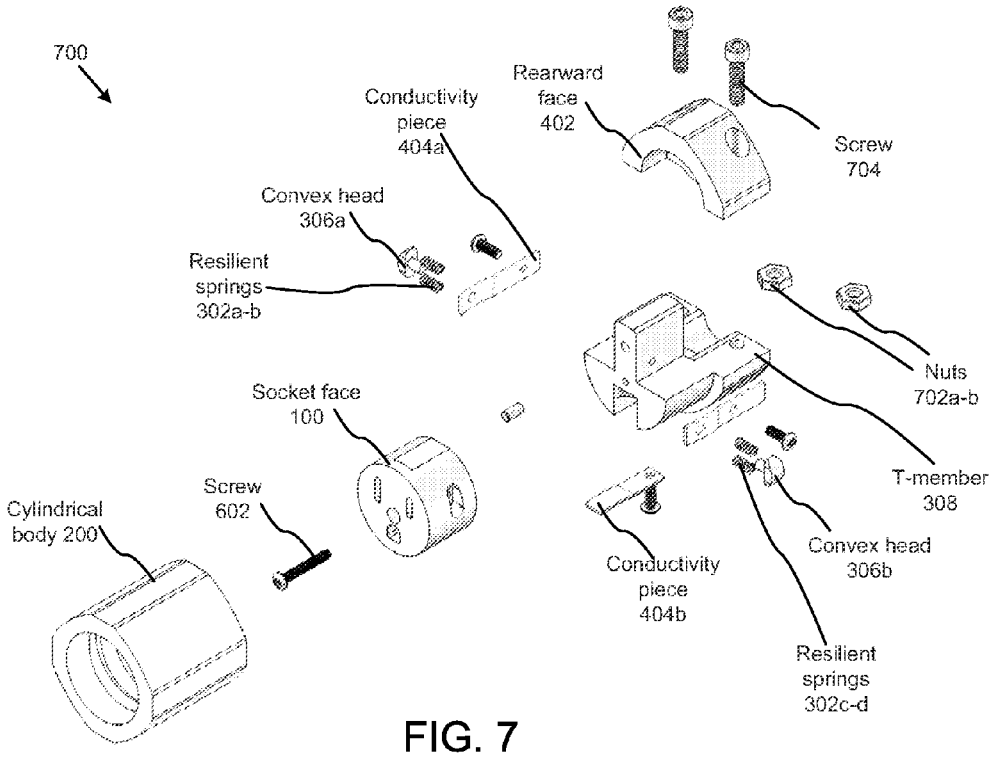
FIG. 7 is a forward side elevational perspective view of a disassembled locking electrical socket in accordance with the present invention.

FIG. 7 is a forward side elevational perspective view of a disassembled locking electrical socket 700 in accordance with the present invention. The electrical socket 700 comprises a cylindrical body 200, a socket face 100, a screw 602, resilient springs 302*a-b*, resilient springs 302*c-d*, conductivity pieces 404*a-b*, convex heads 306*a-b*, a t-member 308, a rearward face 402, nuts 702*a-b*, and a screw 704.

Each of these components are assembled as shown.

Figure 8:
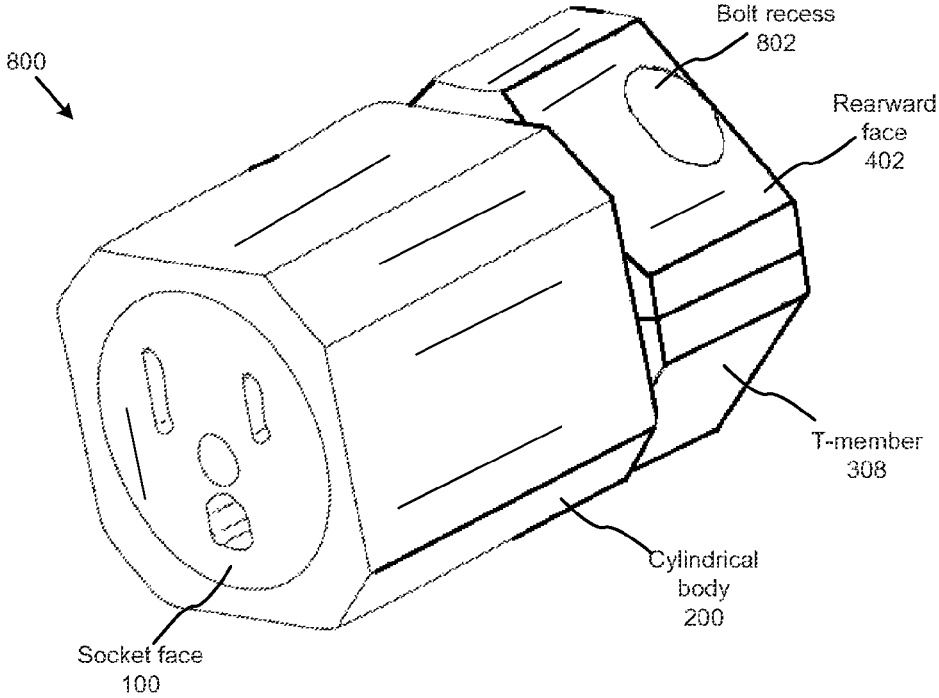
FIG. 8 is a forward side elevational perspective view of a locking electrical socket in accordance with the present invention.

FIG. 8 is a forward side elevational perspective view of a locking electrical socket 800 in accordance with the present invention. The electrical socket 800 comprises a cylindrical socket face 100, a cylindrical body 200, a t-member 308, and a rearward face 402 defining a bolt access recess 802.

The assembled locking electrical socket appears as shown in a half-locked position.

Figure 9:
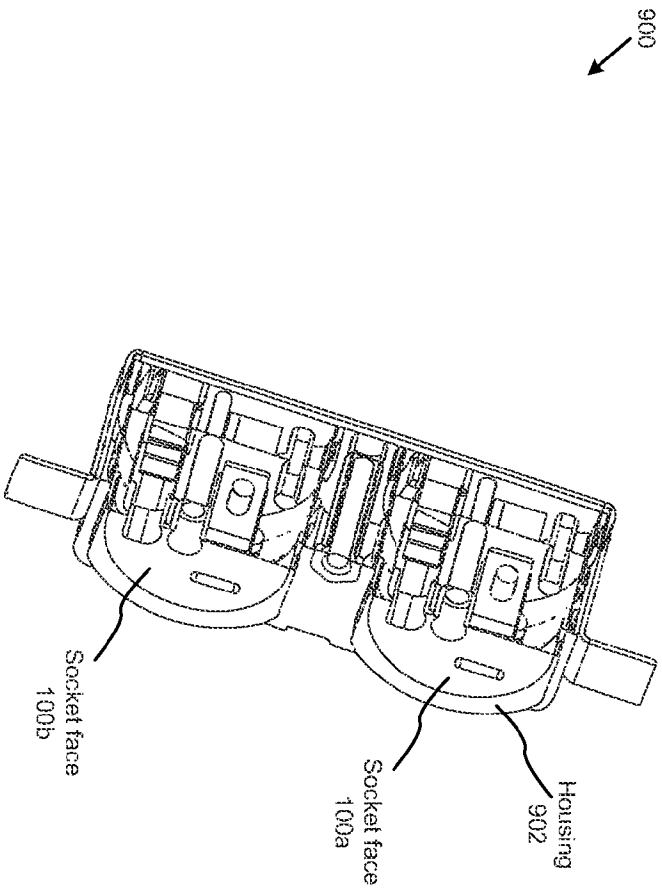
FIG. 9 is a forward side elevational cross-sectioned perspective view of a locking electrical outlet in accordance with the present invention.

FIG. 9 is a forward side elevational cross-sectioned perspective view of a locking electrical outlet 900 in accordance with the present invention. The electrical outlet 900 comprises a housing 902 and two electrical socket faces 100*a-b*.

In the shown embodiment, the electrical outlet 900 comprises a plurality of socket faces 100. The shown embodiment is similar to locking electrical socket 400 with the primary difference being that the socket faces 100*a-b* rotate within the housing 902, rather than the housing 902 rotating around the socket faces 100*a-b* as the cylindrical body 200 would in other embodiments.

Figure 10:
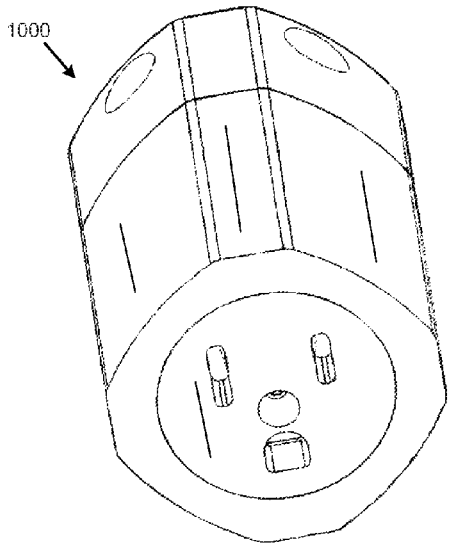
FIG. 10 is a forward elevational perspective view of a locking electrical socket in accordance with the present invention.

FIG. 10 is a forward elevational perspective view of a locking electrical socket 1000 in accordance with the present invention. The electrical socket 1000 appears in its assembled, unlocked position as shown.

Figure 11:
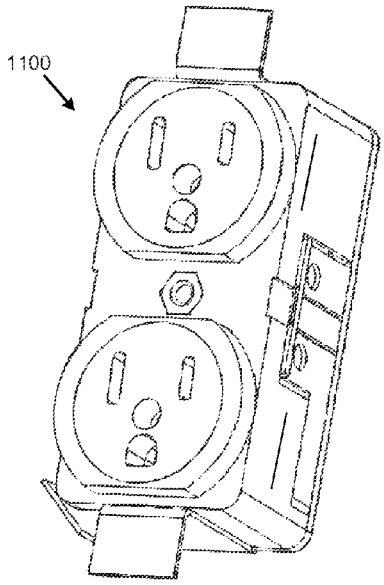
FIG. 11 is a lower elevational perspective view of a locking electrical outlet in accordance with the present invention.

FIG. 11 is a lower elevational perspective view of a locking electrical outlet 1100 in accordance with the present invention. The locking electrical outlet 1100 appears as shown in its unlocked position. After the electrical plug in inserted into the electrical outlet 1100, the plug and socket face 100 are rotated clockwise or counterclockwise within the housing 902.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A locking electrical socket comprising:

a hollow cylindrical body defining an internal recess, the cylindrical body having two open ends for housing a cylindrical socket face and partially housing a t-member, the cylindrical body comprising an internal cam for engaging one more clevis pins, the cam partially circumscribing the inner surface of the cylindrical body;

wherein the internal recess defined by the cylindrical body is of non-uniform diameter, such that the diameter of the recess across a lateral axis is smaller than the diameter of the internal recess across a longitudinal axis;

a cylindrical socket face having two or more jacks for receiving the male prongs of an electrical plug, the jacks comprising one or more conductivity pieces for engaging with electrical contact the male prongs, the socket face defining one or more recesses for receiving one or more clevis pins for closing and engaging apertures on the male prongs;

wherein the clevis pins are biased in an open position by one or more resilient springs, wherein the clevis pins are closed to engage the male prongs by the cam rotating across the clevis pins when the cylindrical body is twisted axially around the socket face; and a rigid member mounted inside the cylindrical body to one of the cylindrical socket face and a component affixed to cylindrical socket face, the rigid member traversing the longitudinal axis of the inner recess, the rigid member of a length longer the diameter of inner recess across its lateral axis, the rigid member of a length less than the diameter of the inner recess across its longitudinal axis, such that cylindrical body can only rotated axially around the rigid member until a diameter of the inner recess as measured across the rigid member is reduced to the length of the rigid member.

2. The locking electrical socket of claim 1, wherein an outer surface of the cylindrical body comprises one or more planar facets.

3. The locking electrical socket of claim 1, wherein the cylindrical socket face further comprises a substantially planar outer face comprising a centrally located bore hole for receiving a screw, the screw affixing the cylindrical socket face to an abutting member partially enveloped by the cylindrical body.

4. The locking electrical socket of claim 1, wherein the clevis pins comprise convex heads, the convex heads engaged by the cam.

5. The locking electrical socket of claim 1, wherein the cylindrical body further comprising a crescent recess interiorly traversing the length of the cylindrical body, the crescent recess expanding the length of the diameter of the inner recess.

6. A locking electrical outlet having a plurality of electrical sockets, the electrical outlet comprising:

a hollow housing defining a plurality of internal recesses, a face of the housing defining a plurality the cylindrical openings, each opening for housing a cylindrical socket face, the housing comprising internal cam for engaging one more clevis pins on the cylindrical socket faces; and a plurality of cylindrical socket faces having two or more jacks for receiving the male pins of an electrical plug, the jacks comprising one or more conductivity pieces for engaging with electrical contact the male pins, the socket face defining one or more recesses for receiving one or more clevis pins for closing and engaging apertures on the male pins when the male pins are insertably and detachably connected to an electrical socket;

wherein the clevis pins are biased in an open position by one or more resilient springs affixed to a socket face, wherein the clevis pins are closed to engage the male pins by the cam rotating across the clevis pins when the socket face is twisted axially within the housing.

* * * * *